US005104341A

United States Patent [19]

Gilissen et al.

[11] Patent Number: 5,104,341

[45] Date of Patent: Apr. 14, 1992

[54] SHIELDED BACKPLANE CONNECTOR

[75] Inventors: Hermanus P. J. Gilissen, Esch; Johannes M. Broeksteeg, Oss, both of Netherlands

[73] Assignee: AMP Incorporated, Harrisburg, Pa.

[21] Appl. No.: 628,762

[22] Filed: Dec. 17, 1990

Related U.S. Application Data

[63] Continuation-in-part of Ser. No. 584,672, Sep. 19, 1990.

[30] Foreign Application Priority Data

Dec. 20, 1989 [GB] United Kingdom ..... 8928777

[51] Int. Cl.[5] ..... H01R 13/652

[52] U.S. Cl. ..... 439/608

[58] Field of Search ..... 439/608, 609

[56] References Cited

U.S. PATENT DOCUMENTS 4,846,727 7/1989 Glover et al. ..... 439/608

4,975,084 12/1990 Fedder et al. ..... 439/608

*Primary Examiner*—Eugene F. Desmond

*Attorney, Agent, or Firm*—Bruce J. Wolstoncroft; Eric J. Groen

[57] ABSTRACT

An electrical connector is shown which is mountable to a printed circuit board (200) which includes a plurality of insulating housings (4). The housings accept a plurality of terminal subassemblies (60) where the subassemblies integrally mold therein a plurality of electrical terminals (64–67). Cross talk shield members (180) are insertable into the rear of the connector housing (4) to shield adjacent vertical rows of terminals from cross talk. Resilient contact members (194 or 194') are stamped from the ground member (180) and are profiled to contact one of the contact members (64 or 65). Upper (100) and lower (100') shield members are insertable over the assembly to shield the assembly from EMI/RFI.

7 Claims, 7 Drawing Sheets

SHIELDED BACKPLANE CONNECTOR

This application is a continuation-in-part of application Ser. No. 584,672 filed Sept. 19, 1990.

FIELD OF THE INVENTION

The present invention relates to an electrical connector assembly for printed circuit boards and more particularly to a high speed impedance matched and shielded backplane connector.

BACKGROUND OF THE INVENTION

In current electronic circuits, the use of increasingly higher speed switching signals has necessitated control of impedance for signal transmission. Also of importance is the need for shielding between the designated signal contacts to prevent from cross talk interference between the adjacent contacts.

At the connector interfaces between motherboards and daughterboards, this has been accomplished primarily by alternating ground terminals with signal terminals in the connectors in order to provide a signal reference path in shielding for the signal path. Traditionally, large numbers of terminals are used for ground, with as many as eight terminals being used as ground for every one that is used for signal. Thus, in the prior art, the number of terminals used for signal transmission is drastically limited, which in turn limits the amount of contact areas which can be beneficially connected between the motherboard and daughterboard for signal connection purposes.

It too is important to provide for an easily manufactured connector with the availability for other options such as exterior RFI/EMI shielding, keying and the like without complicating the system.

SUMMARY OF THE INVENTION

The object of the invention then is to provide for a shielded and impedance matched electrical connector which is easily manufacturable.

Another object is to provide for optional exterior shielding and for shielding between the vertical columns of contacts to prevent cross talk.

The above mentioned objectives were accomplished by designing an electrical connector assembly comprising an insulating housing having a front mating face and a terminal receiving face. The front mating face has an array of apertures aligned in a plurality of vertical rows for the receipt of a plurality of mating contacts. The electrical terminals comprise mating contact portions and conductor connecting portions. Each of the terminals is vertically aligned one above the other, wherein a plurality of terminals are insertable into the connector housing to position the mating contact portions adjacent to a rear side of the apertures. Intermediate each vertical column of contacts is a ground plane member wherein the ground plane member is connected to at least one of the signal contacts.

By so designing the connector assembly, the shield members between each vertical row of electrical terminals prevent cross talk between adjacent terminals in adjacent vertical rows.

BRIEF DESCRIPTION OF THE DRAWINGS

With reference now to the drawings, a preferred embodiment of the invention will be shown where.

DETAILED DESCRIPTION OF THE INVENTION

Figure 1:
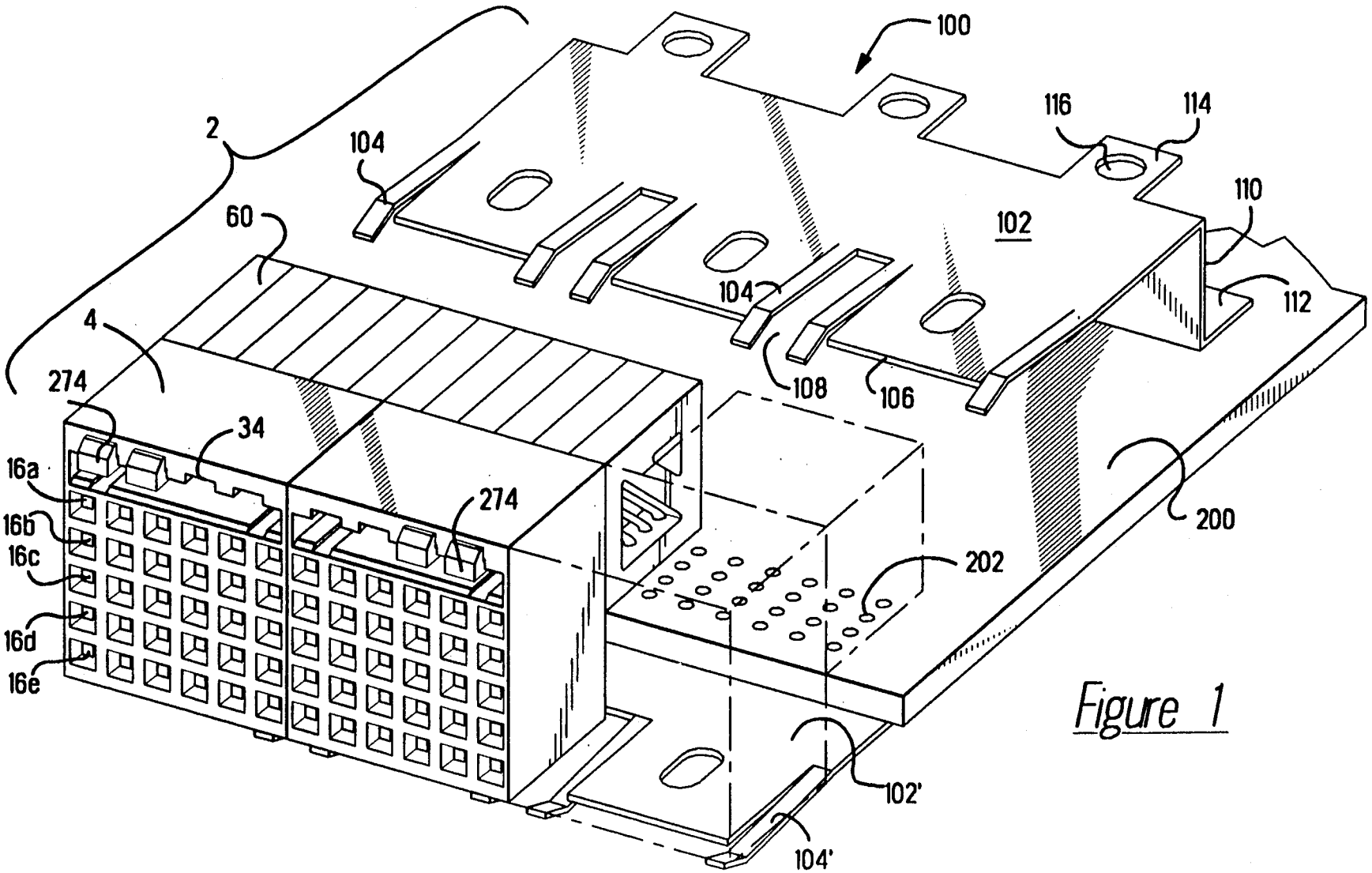
FIG. 1 is a perspective view of the daughterboard connector of the subject invention.
Figure 12:
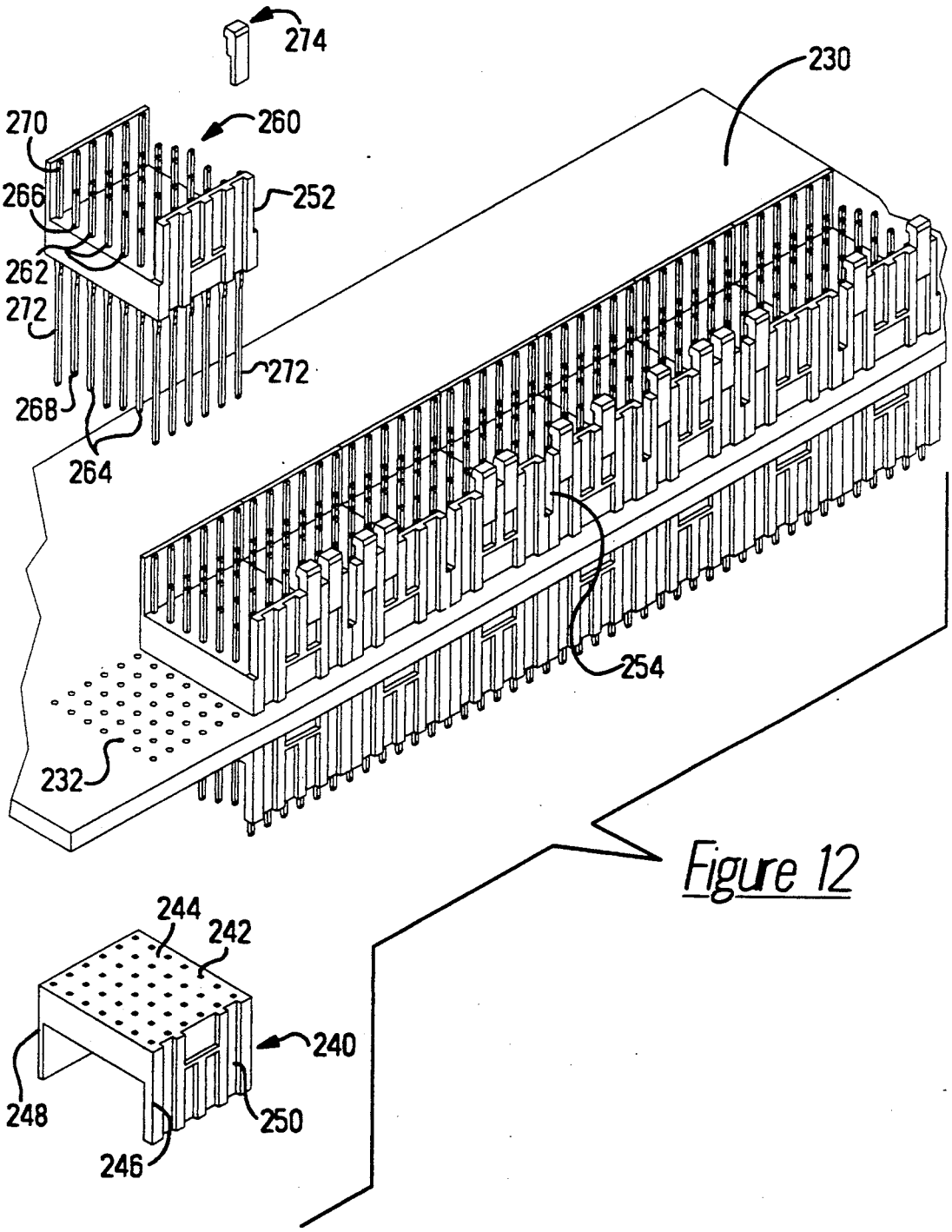
FIG. 12 is an isometric view of the post header.

With reference first to FIGS. 1 and 12, the invention includes a daughter board connection system 2 which is interconnectable with a post header such as that shown in FIG. 12. The electrical connection system 2 of the present invention includes a plurality of housing modules 4 abutted one against the other to form a connection system. It should be understood that while only two such modules are shown in FIG. 1, this is for clarity only. Any number of modules can be used and it is anticipated that a typical connection system would include 8–10 modules.

Figure 2:
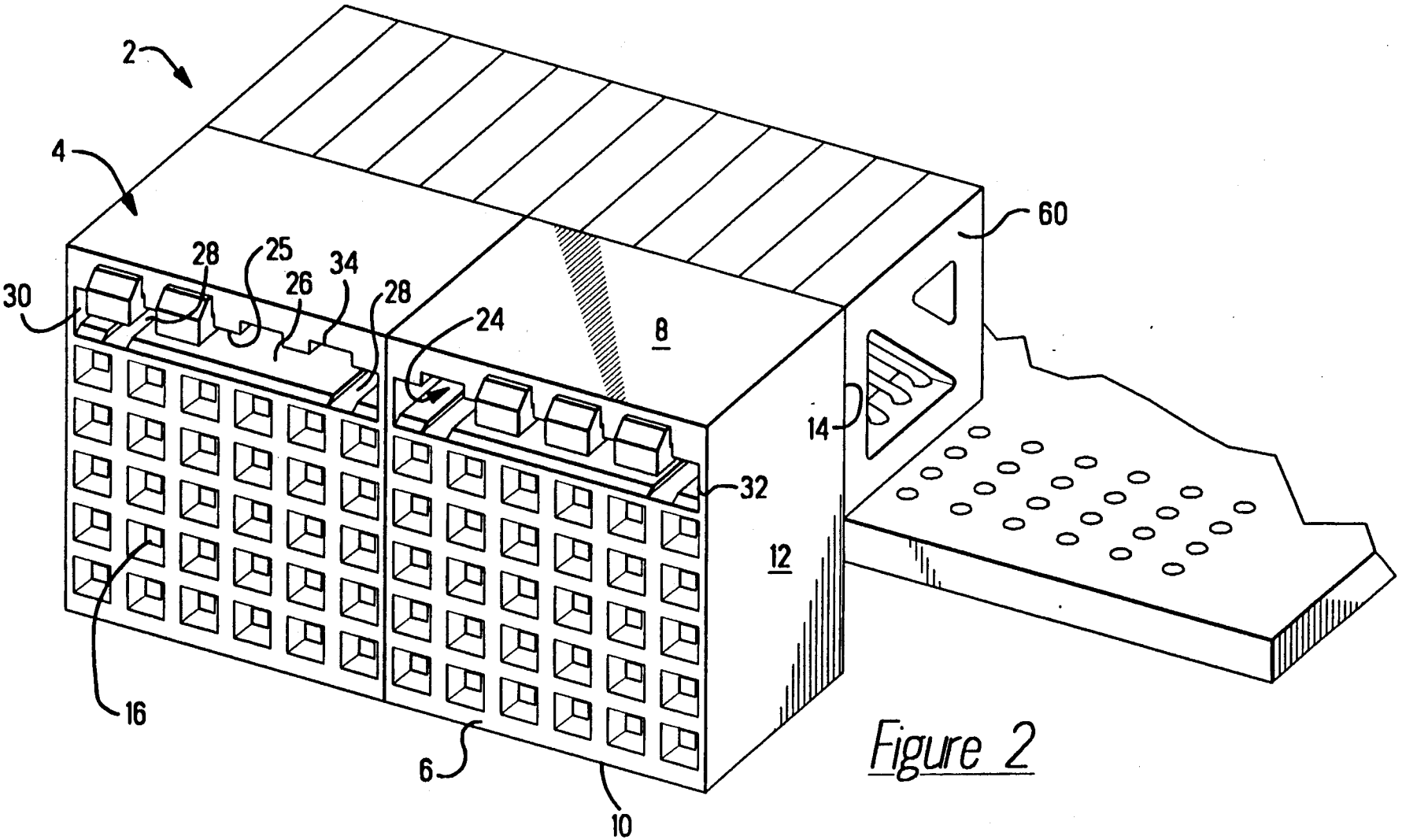
FIG. 2 is an enlarged view of two of the housing modules of the daughterboard connector shown in FIG. 1.
Figure 3:
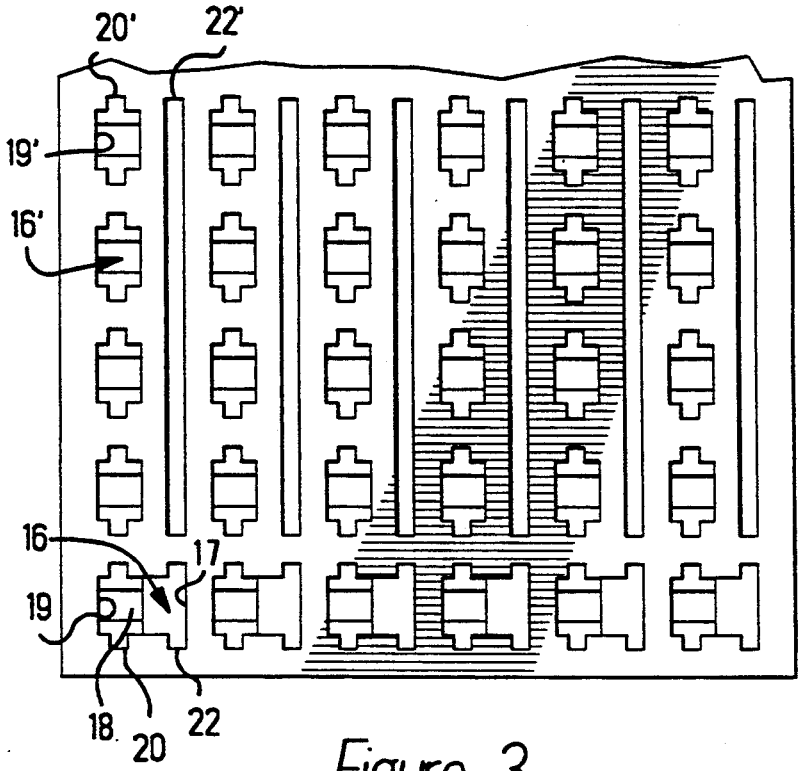
FIG. 3 is a rear view of the connector housing.

With reference now to FIG. 2, each of the modules 4 includes a front mating face 6 having a plurality of pin receiving apertures 16, a top wall 8, a bottom wall 10, sidewalls 12, and a rearwall 14. With reference to FIG. 3, the pin receiving apertures 16 include a narrow through hole 18.

With reference to FIG. 3, which is a rear view of the housing member 4, the cross sectional configuration of the aperture 16 is shown in greater detail. The aperture 16 includes two vertical slots 20 and 22 where the first vertical slot 20 is symmetrical with the center of the narrow aperture 18 whereas the second vertical slot 22 is flush with the right hand (as shown in FIG. 3) sidewall 17. It should be noted that the aperture 16, as defined by the sidewalls 17,19 is asymmetrical with the center line of the narrow aperture 18, the reason for which, will be described in greater detail herein.

With reference still to FIG. 3, the housing further comprises a plurality of apertures 16' which include vertical slots 20'. To the right of the apertures 20' are slots 22' which are vertically aligned with the vertical slots 22.

With reference again to FIG. 2, just below the topwall 8 is located an elongate slot 24, which is defined by an upper surface 25, a lower surface 26 and sidewall surfaces 30. The upper surface 25 has a plurality of slots 34 therein for the receipt of keying members 274, and the lower surface 26 includes two raised sections 28, which will be described more fully herein.

Figure 4:
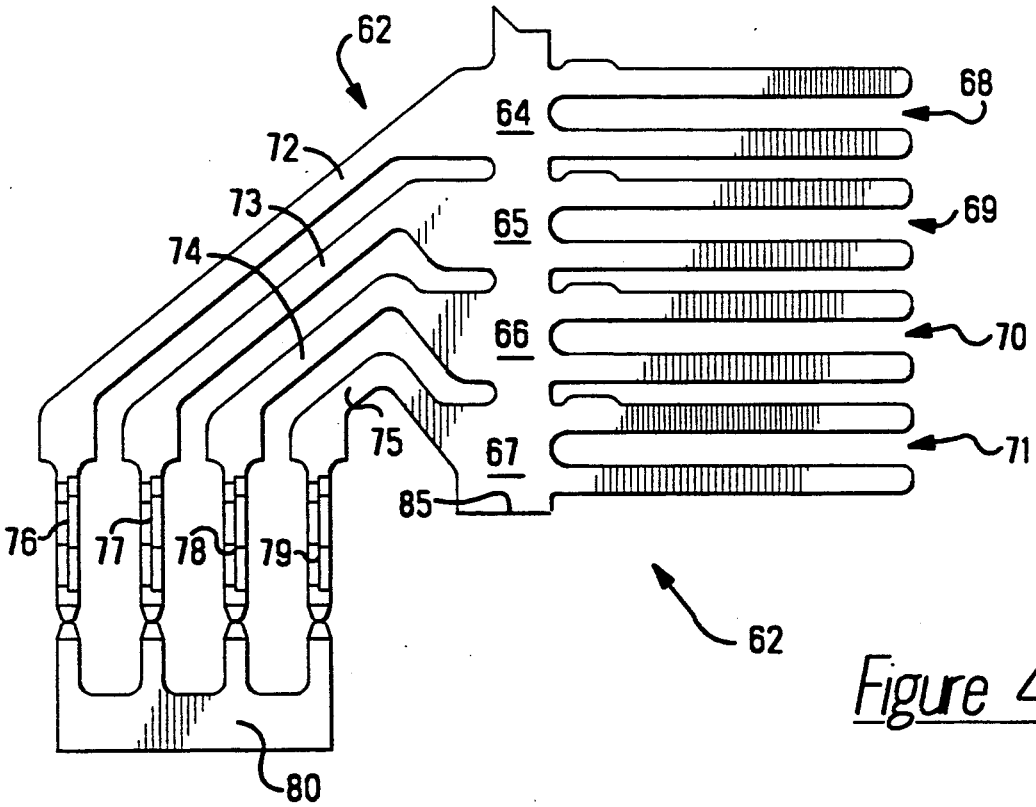
FIG. 4 is a plan view of the stamped blank of the terminal subassembly.
Figure 6:
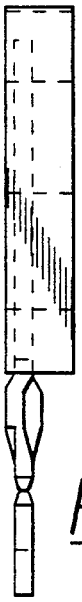
FIG. 6 is an end view of the subassembly of FIG. 5.
Figure 7A:
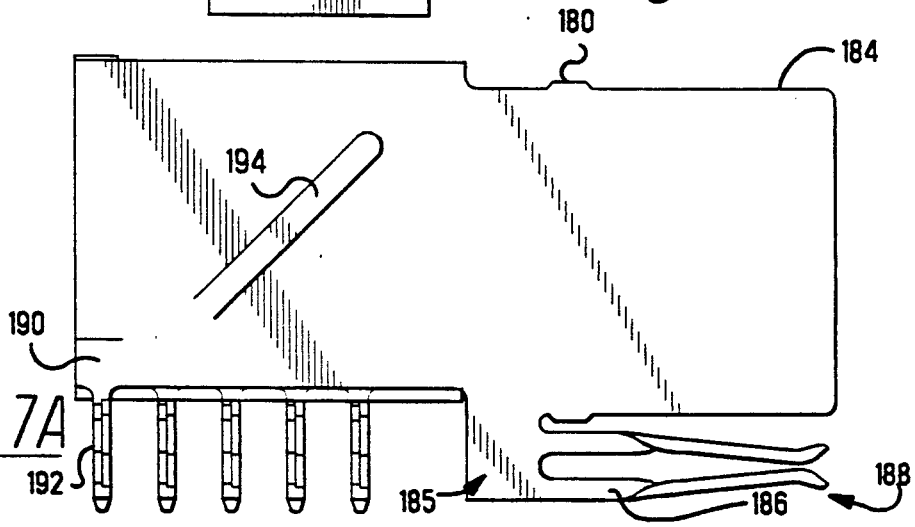
FIG. 7A is a side plan view of the cross talk shield member with the integral contact member.
Figure 7B:
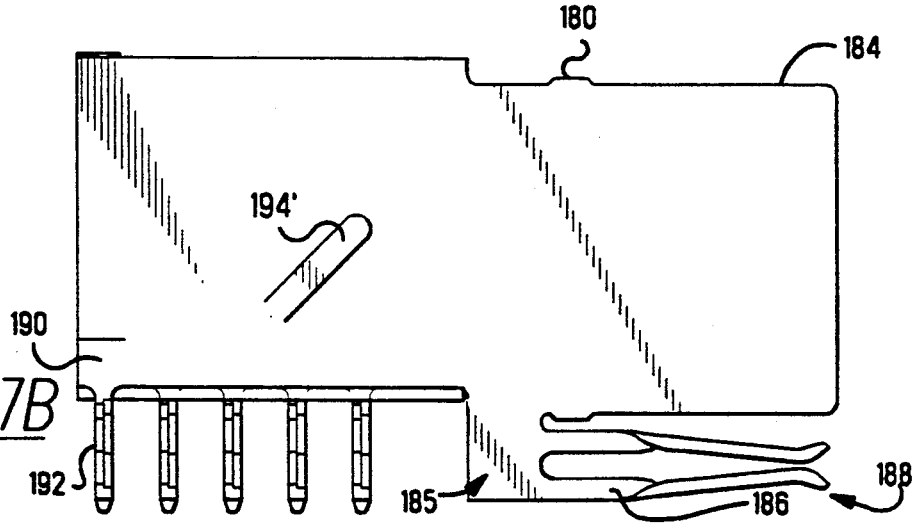
FIG. 7B is a side plan view similar to that of FIG. 7D showing a further embodiment.
Figure 7C:
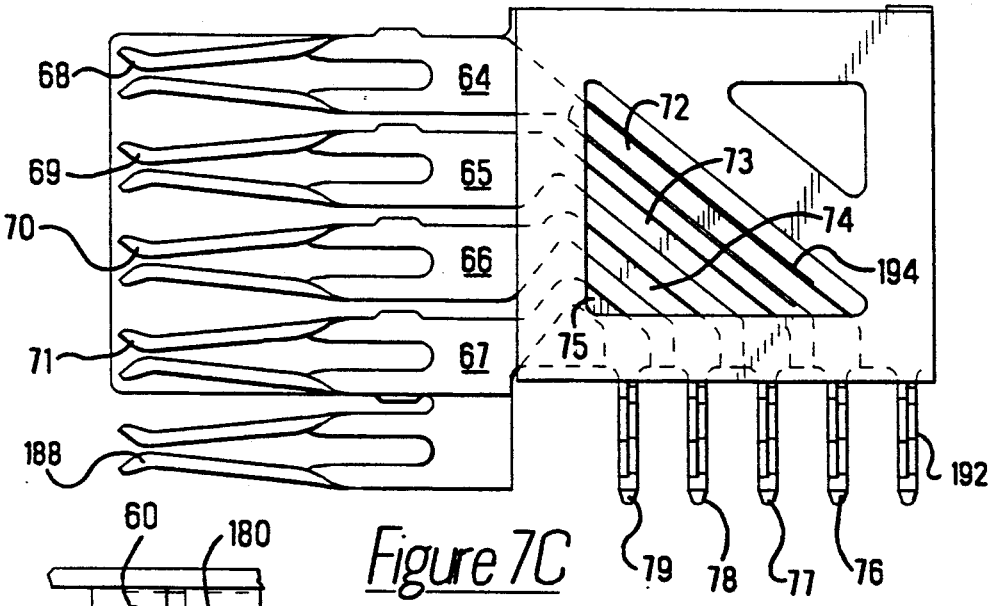
FIG. 7C is a side plan view of the cross talk shield of the present invention.

The terminal subassembly 60, shown in FIG. 7C is manufactured by stamping a terminal lead frame 62, as shown in FIG. 4, having a plurality of individual terminal members 64,65,66 and 67. Each of the terminals 64–67 include stamped contact portions 68,69,70 and 71. The contacts 64 through 67 also include intermediate sections 72,73,74 and 75 which interconnect the contact portions 68 through 71 to compliant pin sections 76 through 79 respectively.

Figure 5:
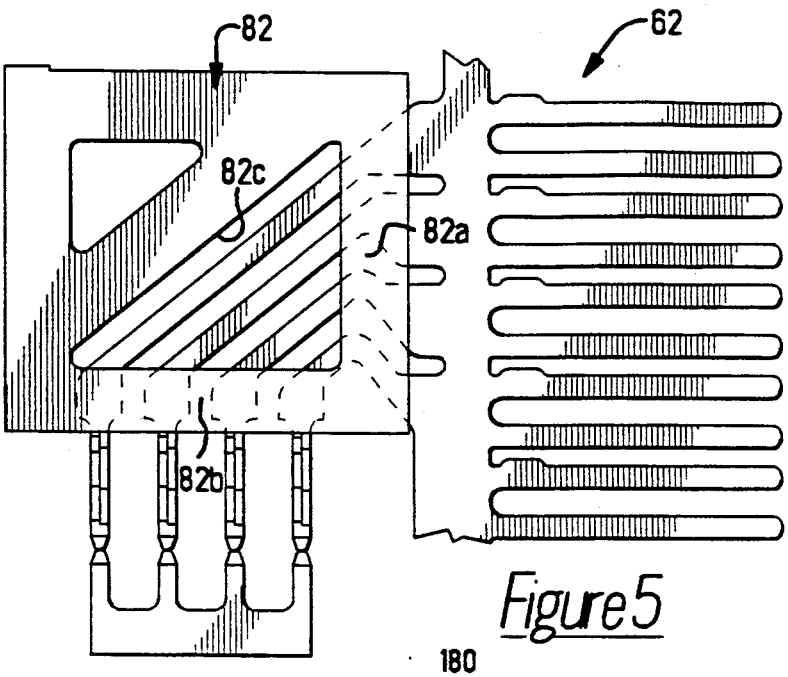
FIG. 5 is a view similar to that of FIG. 4 showing the molded web over the terminal lead frame.

Once the terminal lead frame is stamped, a web of insulating material 82 (FIG. 5) is molded over the terminal lead frame 62 such that one leg 82*a* spans and integrally retains, at least a portion of each of the intermediate portions, 72*a*,73*a*,74*a* and 75*a*. Items 72*a*–75*a* will be referred to as that portion of the intermediate portions 72–75 which is integrally molded within the insert 82. The molded web 82 also includes a leg 82*b* which is molded at a 90° angle relative to the leg 82*a* and spans and integrally holds the plurality of terminals adjacent to the compliant pin sections 76–79.

By molding the legs 82*a* and 82*b* over the sections of the terminals, a window or opening 82*c* is formed over the terminal intermediate sections 72–75, which are not integrally molded in the web 82. It should be noticed first that the intermediate sections 72–75 are not equal in signal length, which is typical of any right angle connector. Thus, if the signal speed is equal in all of the terminals 64–67, a reflection would occur, and there would be a lag in the pulse signal in any two of the terminals 64–67, which could lead to a faulty switching signal, if two of the signals are being used in the same switching device. Therefore, the molded web, together with the length difference of the sections 72*a*–75*a*, changes the impedance of the terminals 72–75 and thereby matches the impedance.

It should also be noticed that the molded web 82 gives a generally rectangular shape having an upper horizontal surface 82*d*, a rear perpendicular surface 82*e*, a lower horizontal surface 82*f* and a forward perpendicular edge 82*g*.

With reference now to FIG. 1, the shield member 100 is shown as including an upper plate portion 102 having integral and resilient fingers 104 stamped and formed from the plate portion 102. It should be noticed that between each pair of fingers 104 is defined a slot 108. The shield member 100 further includes a rearwall 110 and a foot portion 112. Stamped from the rear wall is a plurality of tab members 114 having apertures 116 therethrough.

As shown in FIG. 7A, the shield member 180 includes a planar section 182 having a shielding plate 184 extending therefrom. Stamped out of the shielding plate section 184 is a contact member 194 which is biased inwardly towards the contact sections. The contact member 194 is stamped such that it is parallel with the intermediate section of terminal (72–75) to which it will connect. A fifth contact member 185 is also included which is electrically connected to the ground member 180 and has a staggered section 186 and an opposed contact section 188. Another staggered section 190 is included which has a compliant section 192 extending therefrom.

Figure 8:
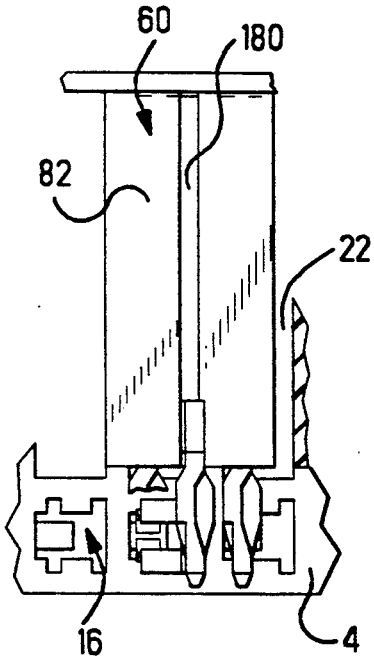
FIG. 8 is a rear cross-sectional view showing the terminal subassembly and cross talk shield of FIG. 7A inserted in a rear housing module.
Figure 9:
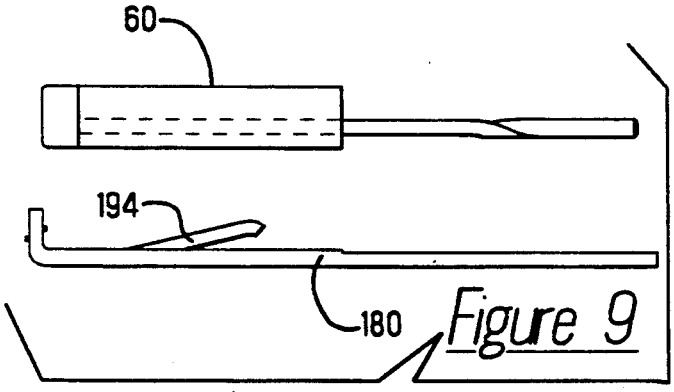
FIG. 9 is a top plan view of the ground plane insertable onto the terminal subassembly.
Figure 10:
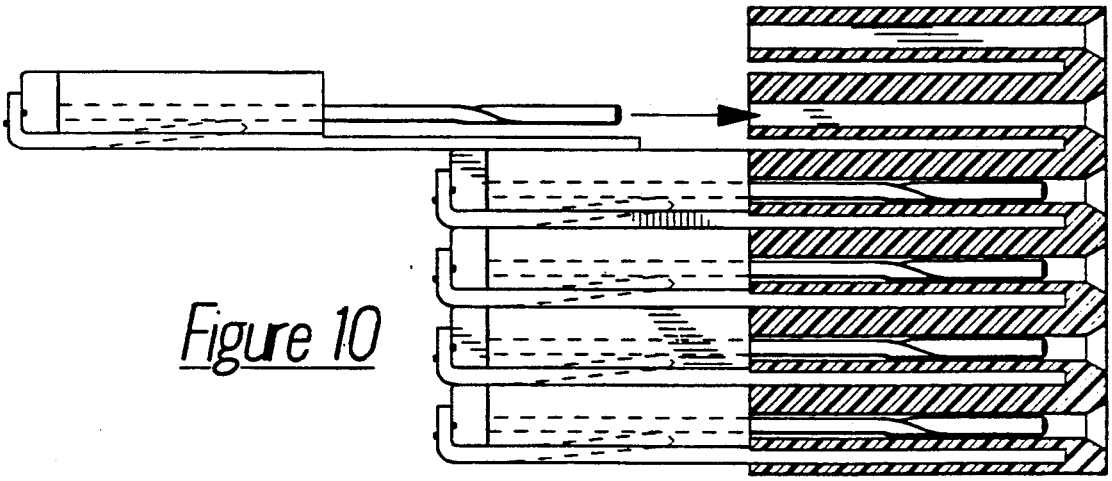
FIG. 10 is a top cross-sectional view showing the insertion of the terminal subassembly and cross talk shield into the housing.

As shown in FIG. 9, the cross talk shield is assembled to the terminal subassembly such that the terminal 194 extends within the window section 82*c* of the terminals subassembly 60, and is biased against one of the terminal intermediate sections. When the cross talk shield member 180 and terminal subassembly 60 are inserted into the module 4, the plate portion 184 of the shield member 180 resides within the respective vertical slot 22, while the individual terminals reside within their respective openings 16′ as shown in FIG. 8. As shown in FIG. 8 the thickness of the molded web and the thickness of the shield are dimensioned to stack up and resile in the spacing provided at the rear of the housing 4. At the lower horizontal row of contacts, the opposed contact sections 188 of shield 180 are stepped over, via the section 186, to align the opposed contacts 188 with the lower horizontal row of apertures 18. This allows the posts 266 (FIG. 12) to be used to ground the individual cross talk shield members.

It should be understood that the contact which is interconnected to the ground contact 194 is now an earth contact rather than a signal carrying contact. It has been found that by adding this further ground connection, that the attenuation of the cross talk noise is further increased. While any of the contacts 68–71 could be used as a further ground contact, for example, outer contact 64 as shown in FIGS. 7A and 7C, it has been found that the best attenuation of the cross talk has resulted when contact 65 (FIG. 7B) is the added ground contact, that is when contact member 194′ is biased against the contact member 65.

With the individual connector modules 4 assembled with terminal subassemblies 60, the housing modules and terminals can be inserted on a printed circuit board 200′ such that the compliant pin sections 76–79 are inserted into the mating through holes 202′, as shown in FIG. 12. It should be noticed that the section 190 also staggers the compliant pin 192 to the left to align it with the ground trace 204′ on the printed circuit board 200′.

Figure 11:
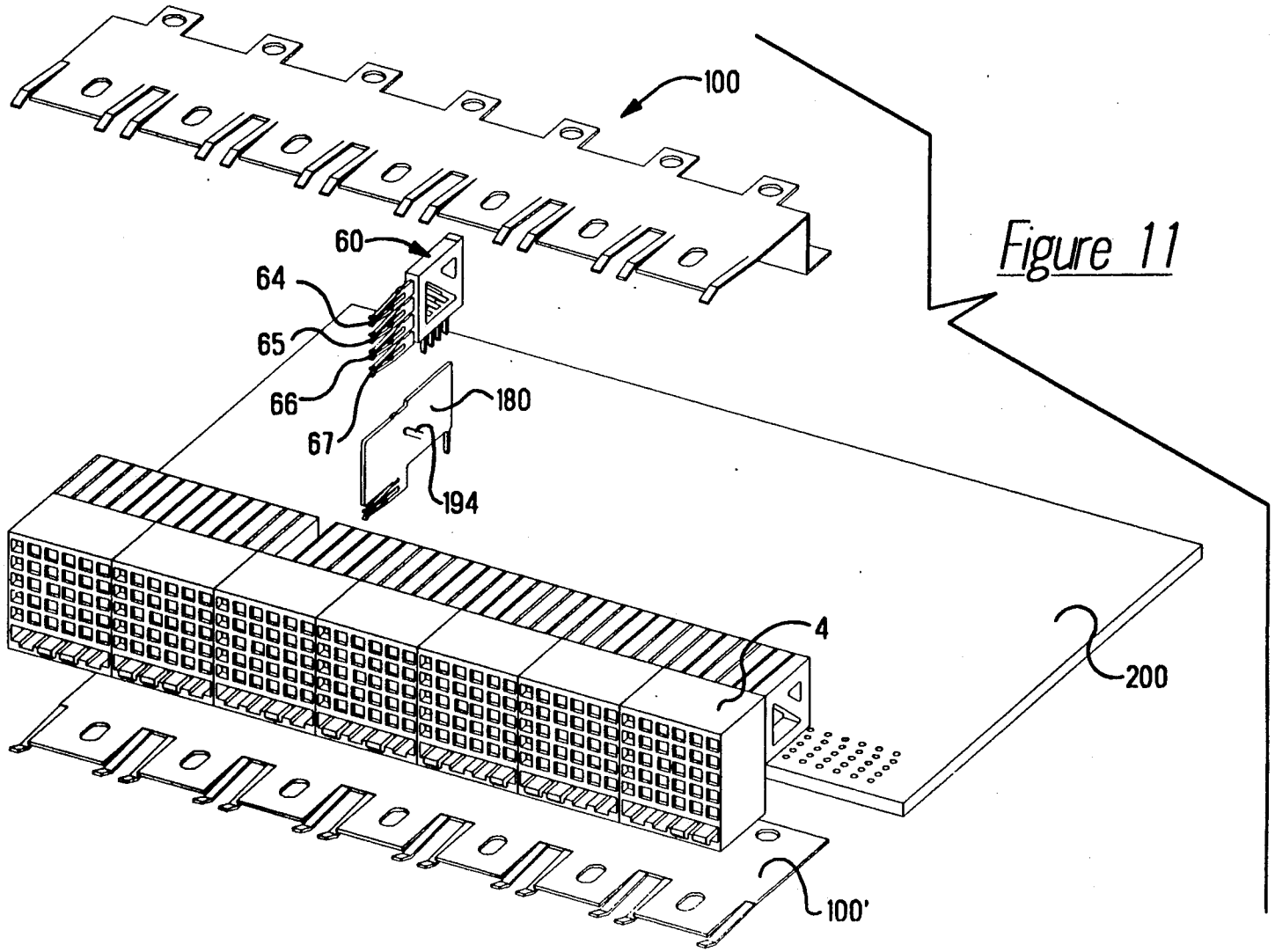
FIG. 11 is an isometric view showing the subject invention with the cross talk shield members in position for insertion.

With the connector modules so installed on a printed circuit board the shield and mechanical stiffener 100 may be assembled to the array of connector modules 4. The shield member 100 is inserted from the rear side of the connector assembly as shown in FIGS. 1 or 11, such that the resilient fingers 104 of the shield are disposed between the inner surfaces 30 in the individual connector housing modules 4. One upper shield member 100 would be used for the plurality of individual connector modules with two resilient fingers 104 dedicated to each singular connector module 4. As assembled, the fingers 104 flank the outside of the lug members 28 and the slots between the adjacent finger members 104 spa the thin wall sections 32 of adjacent housing modules. One lower shield member 100′ is also used as shown in FIG. 4 having resilient fingers 104′.

With reference now to FIG. 12, a backplane 230 is shown as including a plurality of through hole portions 230 in the backplane 230 with a plurality of post headers 260 stacked end to end electrically interconnected to the through hole sections 232. Each of the post headers 260 includes a housing 240 having a lower face 244 with the plurality of post through holes 242 therethrough. The post housing 240 further includes two sidewalls 246 and 248 where one of the sidewalls 246 includes slots 250. The post headers 260 further include a plurality of posts where the posts 262 are designated as the signal contacts, post 266 is for use with the cross talk shield contacts 185 or 185′ and posts 270 are provided as an array of shielding members to shield the signal contacts from EMI/RFI.

We claim:

1. An electrical connector assembly comprising:

an insulating housing having a front mating face and a terminal receiving face, the front mating face having an array of apertures aligned in a plurality of vertical rows for the receipt of a plurality of mating contacts;

a plurality of electrical signal carrying terminals, where each terminal comprises a mating contact portion and a conductor connecting portion, each of the terminals being vertically aligned one above the other, wherein a plurality of terminals are insertable into the connector housing to position the mating contact portions adjacent to a rear side of the apertures; and a shield member inserted between the vertical rows of terminals, the shield member including a planar section having a shielding plate extending therefrom, and having at least one contact member which moves laterally into contact relation with at least one of the signal carrying terminals in an adjacent vertical row.

2. An electrical connector assembly as recited in claim 1 wherein the shield member includes a planar section having a shielding plate extending therefrom, the contact member extends from the shielding plate and is biased toward the terminals.

3. An electrical connector assembly as recited in claim 2 wherein a grounding mating contact portion is electrically connected to the shield member, the grounding mating contact portion has a staggered section and an opposed contact section.

4. An electrical connector assembly as recited in claim 2 wherein respective signal carrying terminals have insulating material molded thereover, an opening being provided in the insulating material.

5. An electrical connector assembly as recited in claim 4 wherein the contact member extends within the opening and is biased against a respective terminal.

6. An electrical connector assembly as recited in claim 1 wherein the electrical connector assembly has a plurality of housing modules abutted one against the other.

7. An electrical connector assembly as recited in claim 1 wherein an elongated slot is provided in the insulating housing, the elongated slot has a plurality of keying slots provided therein for receipt of keying members.

* * * * *